United States Patent [19]

Erickson

[11] 4,235,468

[45] Nov. 25, 1980

[54] BOTTLE CARRIER

[76] Inventor: Gerald Erickson, P.O. Box 747, Palm Beach, Fla. 33480

[21] Appl. No.: 29,715

[22] Filed: Apr. 13, 1979

[51] Int. Cl.[3] ..... B65D 71/00

[52] U.S. Cl. ..... 294/87.2; 206/151; 206/158

[58] Field of Search ..... 294/87.2, 87 R, 87.26, 294/87.28; 206/151, 158, 199, 427; 224/45 AA, 45 AB, 45 BA; 179/176, 178; 215/250, 251, 253

[56] References Cited

U.S. PATENT DOCUMENTS

| | | | |
|---|---|---|---|
| 2,823,063 | 2/1958 | Toensmeier | 294/87.2 |
| 3,589,509 | 6/1971 | Mascia et al. | 206/151 |
| 3,930,588 | 1/1976 | Coursaut | 215/253 |
| 4,139,094 | 2/1979 | Berry et al. | 206/158 |

*Primary Examiner*—James B. Marbert

*Attorney, Agent, or Firm*—Brumbaugh, Graves, Donohue & Raymond

[57] ABSTRACT

An integrally formed bottle carrier in which an upper frame contains a plurality of bottle supporting collars for receiving and supporting therein the necks of bottles and in which a bottle retaining bar forming a loop around the cluster of bottles is secured below the frame by a plurality of integrally formed depending supports.

14 Claims, 9 Drawing Figures

BOTTLE CARRIER

This invention relates to an integrally formed bottle carrier for supporting a plurality of bottles and maintaining them in a relatively close cluster.

The integrally formed bottle carrier of the present invention provides a plurality of bottle supporting collars for receiving and supporting therein the necks of the bottles to be carried, an upper frame for supporting the collars in spaced apart relationship to each other so that the bottles are closely clustered, a bottle retaining bar below the frame and forming a closed loop around the cluster of bottles and a plurality of depending supports from the frame for supporting the bottle retaining loop bar.

Bottle carriers capable of supporting a plurality of bottles by their necks have been heretofore proposed. For example, bottle carriers of this type are disclosed in U.S. Pat. Nos. 3,633,962, issued Jan. 11, 1972, and 4,093,295, issued June 6, 1978. Although bottle carriers of this type have provided effective and economical carriers which display the bottles assembled therein, the bottles are free to move relative to and strike one another with possible damage to the bottles.

There is currently available a carrier which consists essentially of a formed shroud which covers and conceals the upper ends of the bottles and has openings therein for receiving and supporting the necks of a cluster of bottles. This carrier is disclosed in U.S. Pat. No. 4,139,094, issued Feb. 13, 1979. The shroud is contoured to the shape of the clustered bottles and thus maintains the bottles in a close cluster. However, it covers and conceals at least the upper portions of the bottles. The shroud is bent, distorted and ultimately destroyed as the bottles are removed therefrom so that it cannot be reused.

The bottle carrier of the present invention provides an economical and effective bottle carrier which does not conceal the upper or any other portion of the bottles carried therein. It is attractive, inconspicuous, rugged and reusable.

Ancillary and optional advantages and features of the bottle carrier of the present invention are that: the bottle retaining loop bar serves not only to effectively and closely contain the cluster of bottles, but to assist in the removal of a bottle from the carrier; the carriers are nestable for storage or packaging in a relatively small space; the carriers are provided with bottle dividers integrally formed with and depending from the frame to engage adjacent bottles and thereby cooperate with the retaining loop bar to maintain a close cluster of bottles; and the carrier include tamperproof closures integrally formed as part of the bottle carrier.

These and other advantages and features of the present invention will be apparent from the detailed description which follows and from the accompanying drawings, in which.

Figure 1:
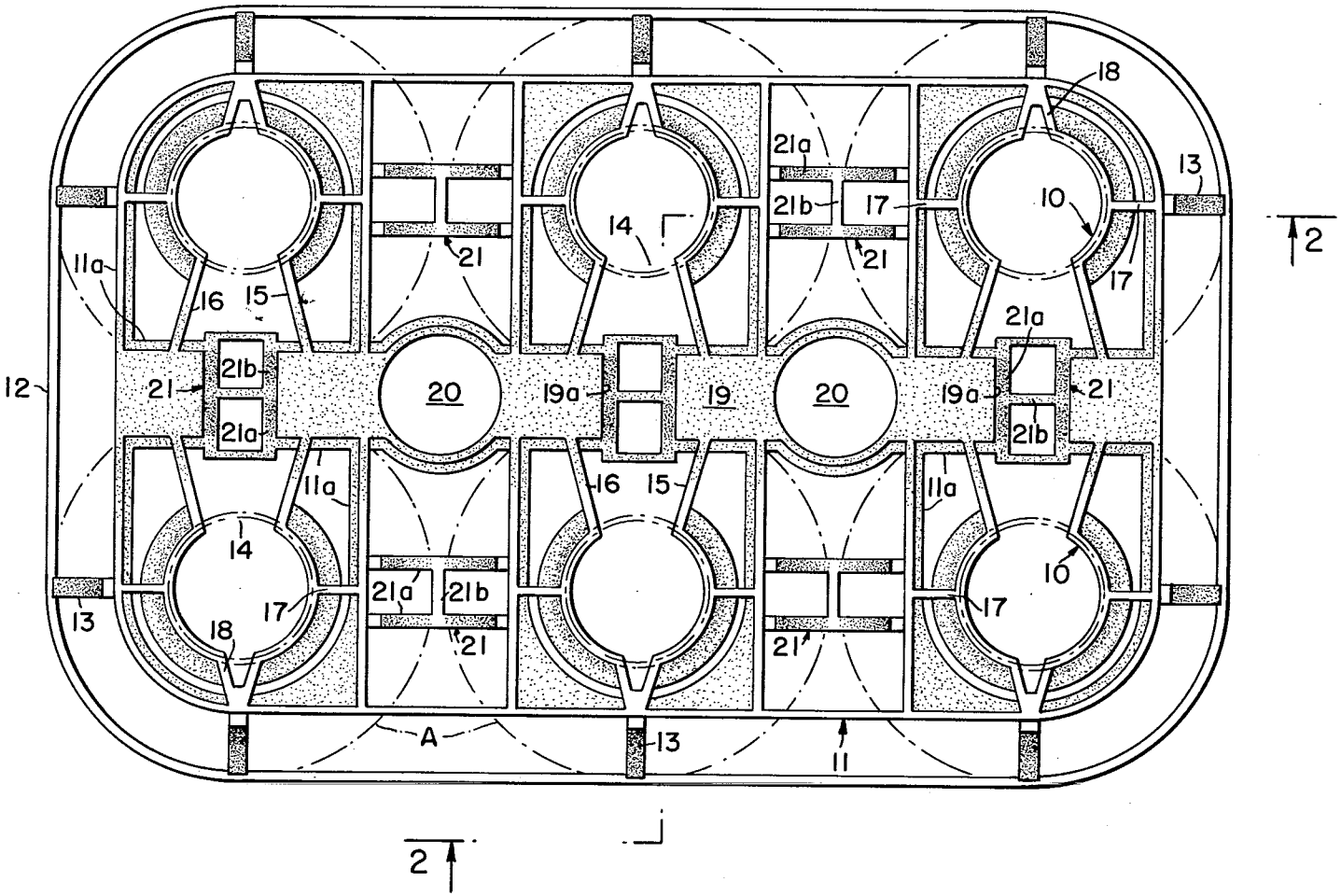
FIG. 1 is a plan view of a bottle carrier embodying the present invention.
Figure 2:
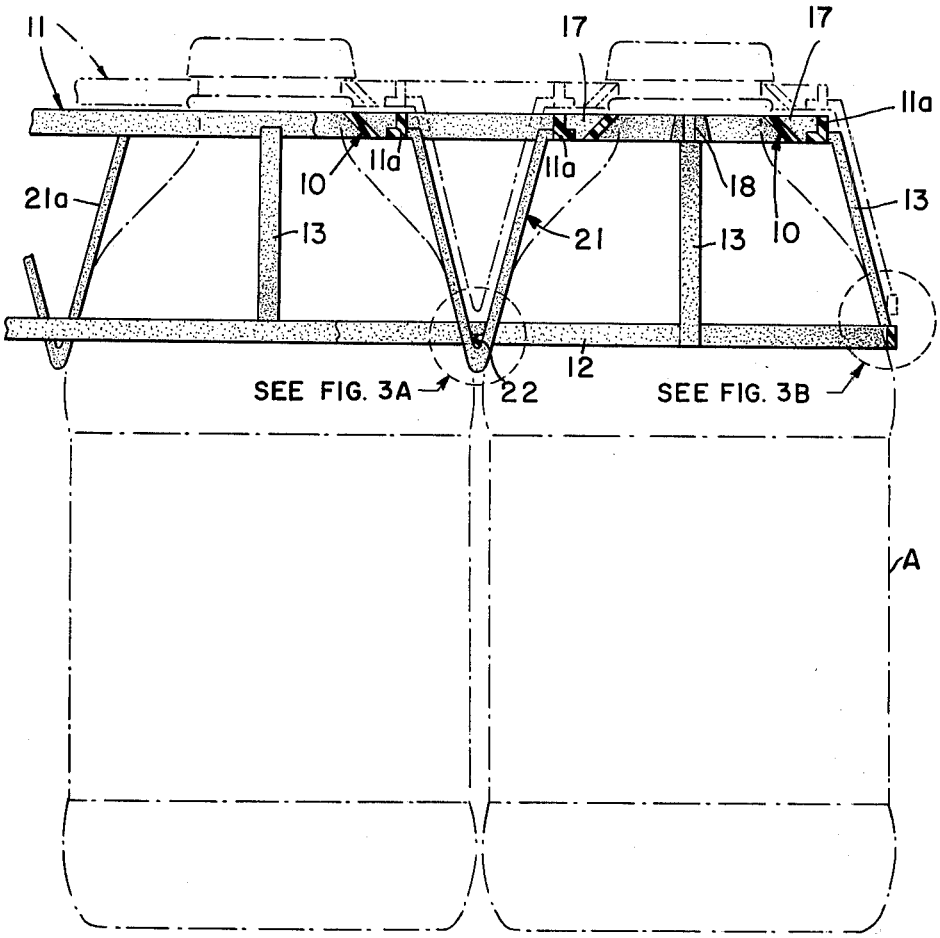
FIG. 2 is a sectional view taken along the line 2—2 of FIG. 1 looking in the direction of the arrows and showing another bottle carrier in phantom lines in nested relation therewith.

A bottle carrier embodying the present invention, shown in FIGS. 1 and 2, includes a plurality of spaced collars 10 for receiving and supporting therein the necks of bottles A to be packaged, a frame 11 for supporting the collars in spaced relation, a bottle retaining bar 12 beneath the frame and formed in a closed loop encircling the bottles to be packaged and supports 13 depending from the frame for supporting the bottle retaining loop bar.

The collars 10 and the frame 11 are generally similar to the six-bottle carrier disclosed in U.S. Pat. No. 3,633,962. The frame 11 is subdivided into a plurality of individual frames 11*a* each containing one of the collars 10. The collars are preferably spaced so that the distance between the centers of adjacent collars is substantially the width or diameter of the bottle to be carried, as shown in FIG. 1.

The collars 10 are tapered conical sections larger at the bottom than at the top to facilitate the insertion of the bottle necks therein from the bottom. Each collar is split to provide an enlarged opening 14, and the split ends are connected to the inner leg of the individual frame by a pair of connections 15 and 16 which extend diagonally away from each other from the split ends toward the frame leg to which they are connected. The angular relationship of the connections 15 and 16 permits the split collar to be forced open to facilitate insertion and removal of a bottle while at the same time providing support for the split collar to prevent it from sagging under the weight of a bottle and offering resistance to accidental spreading of the split collar when it is supporting a bottle therein.

The collar 10 is also supported within its individual frame by lateral supports 17 and by a yoke 18 directly opposite the opening 14. The yoke 18 serves as a pivot for the two components of the collar to facilitate their spreading for the insertion and removal of a bottle.

The frame 11 includes a longitudinally extending bar 19 which, in the six-bottle carrier shown in FIGS. 1 and 2, extends substantially the length of the longer dimension of the frame. The bar 19 includes a pair of finger openings 20 therein to facilitate handling. If desired, a handle can be provided or the bar 19 can serve as a handle.

The bottle retaining loop 12 engages portions of the outer bottles in the cluster to hold them together. Toward this end, it is preferably a continuous bar or rail spaced below the supporting collars 10 and frame 11 at about the shoulder height of the bottles. At this level the retaining loop bar 12 does not interfere with the pivotal motion of the lower end of the bottle which is necessary to remove the neck from the split collar; in fact, the bar actually facilitates the removal of the bottle by providing a back-up bar to help force the neck out of the collar opening.

The frame 11 carries a plurality of bottle engaging wedge-shaped dividers 21 to maintain the bottles in side-by-side or closely spaced relationship, as desired. The upper ends of the dividers are integrally formed with and depend downwardly from pairs of adjacent legs of collar supporting frames 11*a*. They each include a pair of spaced apart members 21*a*, in this embodiment V-shaped, joined at the lower ends by a connection 21*b*. The lower ends of the dividers 21 are wedged between the shoulders of adjacent bottles, and they cooperate with the outer loop bar 12 to hold the bottles in a tight cluster.

Figure 3A:
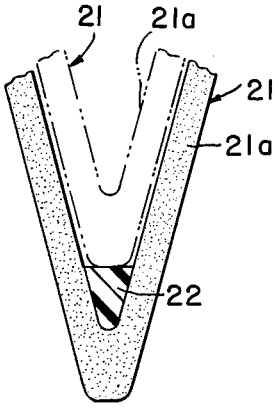
FIGS. 3A and 3B are enlarged portions of the areas indicated in FIG. 2.
Figure 3B:
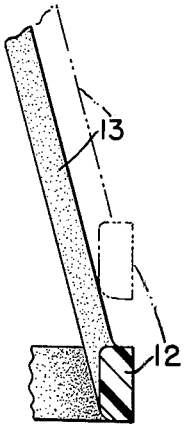

The bottle carriers are nestable so that they can be stacked in a small space for packaging and for storage in the chute of a machine from which they are automatically dispensed. Toward this end, in the nested condition of the bottle carriers, as shown in FIGS. 2, 3A and 3B, the loop bar of the upper bottle carrier is capable of encompassing the frame of the underneath bottle carrier when the two are nested. The bottle dividers 21 of a pair of nesting carriers also intermesh. In nesting relationship the upper frames 11 and the retaining loop bars 12 of the two nesting carriers settle in closely spaced relationship.

In order to permit the intermeshing of the depending bottle dividers 21 for the nesting of a pair of bottle carriers, the frame 11 of the lower carrier must contain openings at the upper ends of each of the bottle dividers to permit the depending dividers of the upper carrier to intermesh with the depending dividers of the lower carrier. The longitudinally arranged bottle dividers present no difficulty in this regard because they are arranged intermediate open portions of the frame between the individual frames 11*a*, but transverse slots 19*a* must be provided in the longitudinally extending bar 19 for this purpose.

To prevent the bottle dividers 21 of nesting carriers from becoming too tightly interlocked, the nesting action is limited by stops 22 formed at the lower ends of the dividers 21.

Figure 4:
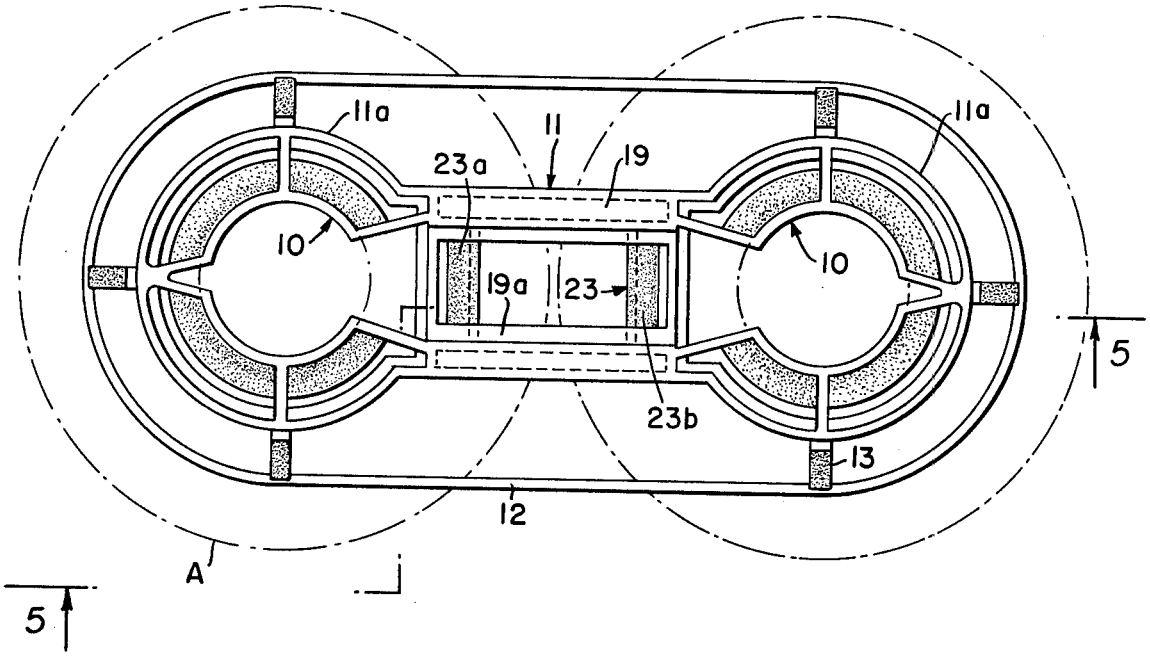
FIG. 4 is a plan view of another bottle carrier embodying the present invention.
Figure 5:
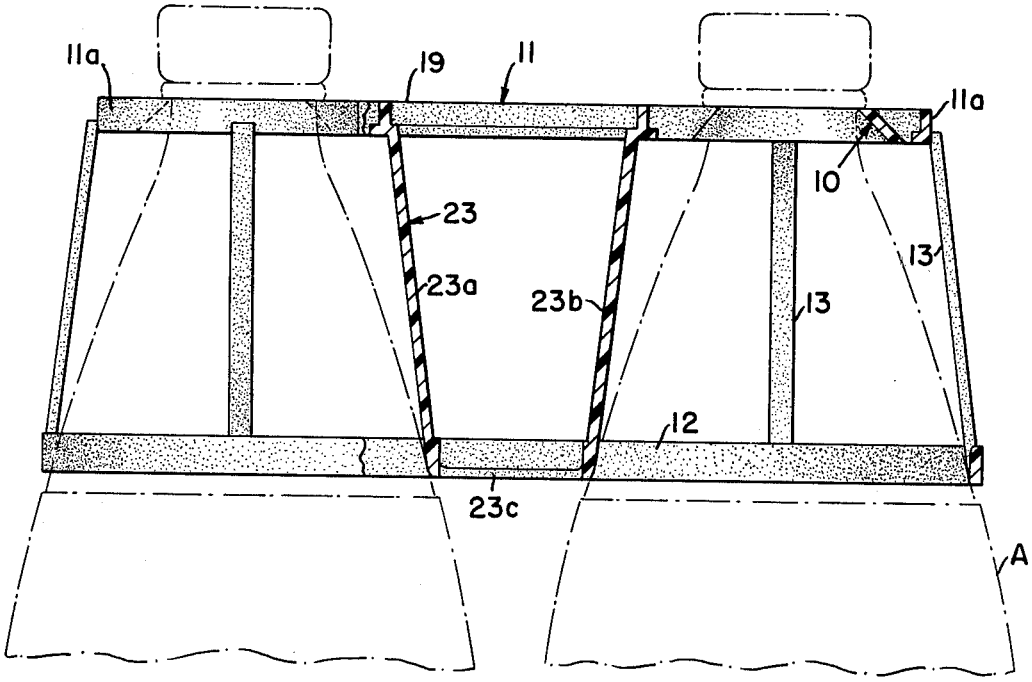
FIG. 5 is a sectional view taken along the line 5—5 of FIG. 4 looking in the direction of the arrows.

A two-bottle carrier embodying the present invention is shown in FIGS. 4 and 5 and includes a pair of collars 10 supported in oppositely oriented relationship in a frame 11. The spacing between the collars 10 is the same as in the embodiment shown in FIGS. 1 and 2. The frame 11 has a longitudinally extending bar 19 having a collar supporting frame 11*a* at both ends. A bottle retaining loop bar 12 is supported beneath the frame 11 by a plurality of depending supports 13 to maintain the bottles in close cluster relationship.

The frame 11, and more particularly the longitudinally extending bar 19, has integrally formed therewith a depending wedge-shaped bottle divider 23, in this case U-shaped, to maintain the bottles in side-by-side or slightly spaced relationship. The divider 23 includes a pair of downwardly depending legs 23*a*, 23*b* joined at their lower ends by a connection 23*c*. The lower ends of the legs 23*a* and 23*b* engage adjacent bottles about shoulder height and the connection 23*c* has enough rigidity to maintain the bottles in a tight cluster, but also enough flexibility to readily adjust to the space provided between the shoulders of adjacent bottles.

The carrier shown in FIGS. 4 and 5 can be gripped and carried by the bar 19. A longitudinally extending slot 19*a* in the bar 19 accommodates the bottle divider 23 of an upper carrier when the carriers are nested.

Figure 6:
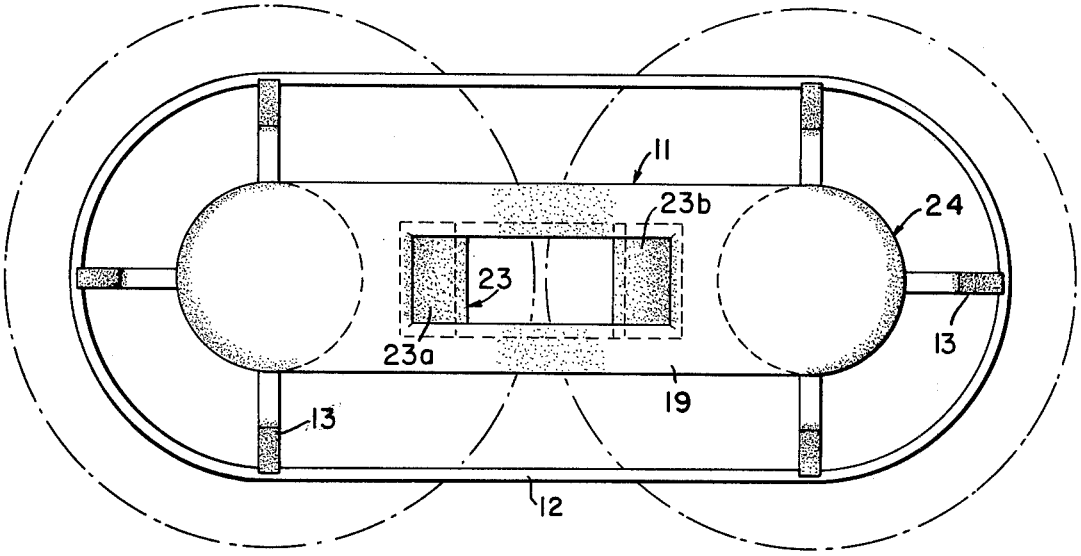
FIG. 6 is a plan view of still another embodiment of a bottle carrier embodying the present invention.
Figure 7:
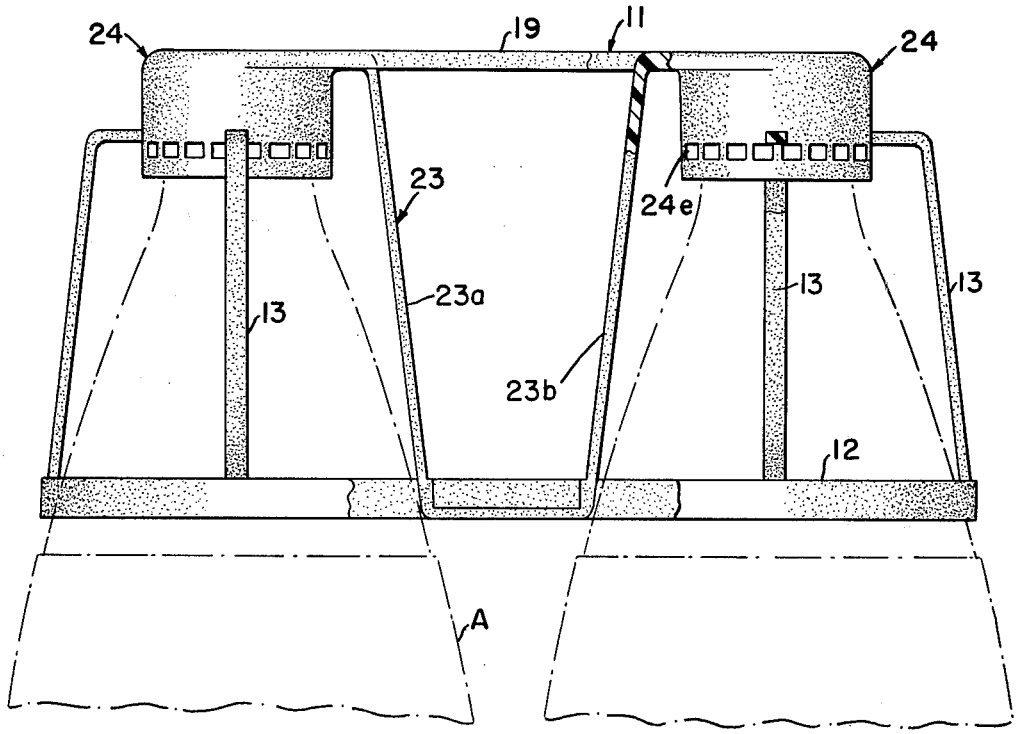
FIG. 7 is an elevational view of the bottle carrier shown in FIG. 6 with parts broken away and shown in cross-section.
Figure 8:
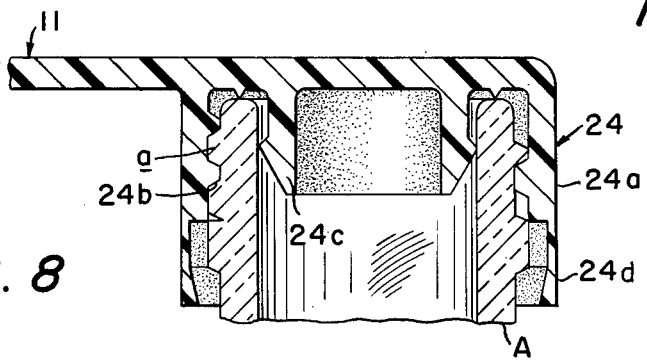
FIG. 8 is a cross-sectional elevation of a portion of the bottle carrier shown in FIG. 7.

The bottle carrier shown in FIGS. 6 through 8 is generally similar to the bottle carrier described in connection with FIGS. 4 and 5, except that bottle closures 24 formed integrally with the frame 11 at opposite ends of the longitudinally extending bar 19 are substituted for the split collars 10. The necks of the bottles can either be snap-locked or screwed into the closures 24.

Each closure 24, as best shown in FIG. 8, includes a cap portion 24*a* having internal threads or ribs 24*b* which interlock with external threads or ribs a formed on the outer periphery of the neck of the bottle. The closure 24 also has an inner depending stopper 24*c* integrally formed therewith to engage the opening in the neck of the bottle to form an effective seal.

When the bottles are filled, the closures 24 are either force-fitted on the bottles or the bottles are screwed into the closures. To insure tamper-proof closures, they are each provided with a shrink ring skirt 24*d* which locks the closure to the neck of the bottle when shrunk by heat and/or pressure. The skirt is connected to the upper portion of the closure by a perforated or weakened line 24*e* which causes the skirt to be separated from the upper portion of the closure when the bottle is forced out of or unscrewed from the closure.

If the skirts of the closures are intact, the customer can be assured of the integrity of the package. If any skirt has been broken or separated from the closure, the customer will be alerted to the fact that the integrity of the package is suspect.

The bottle carrier of the invention is preferably made in one piece of a resilient plastic material, such as injection molded polypropylene. It provides an effective, economical and convenient package for carrying a cluster of bottles in relatively close and controlled fashion. Since the bottles can be inserted and withdrawn without destroying the carrier, the carrier can be used for handling full, partially full and empty bottles and used not only for carrying home a cluster of newly purchased bottles but also for returning the empty bottles.

The invention has been shown in preferred forms and by way of example only, and many modifications and variations may be made therein without departing from the spirit of the invention. The invention, therefore, is not to be limited to any specified form or embodiment, except in so far as such limitations are expressly set forth in the claims.

I claim:

1. An integrally formed one piece injection molded bottle carrier in which a plurality of bottles can be carried in a close cluster without substantial concealment or cover of the upper portions of bottles by the carrier comprising a plurality of bottle neck engaging means for receiving and supporting therein the necks of bottles, a relatively rigid frame for supporting the neck engaging means in spaced apart relationship to each other within the confines of the outer perimeter of the frame to insure that the bottles are closely clustered together, a bottle retaining loop bar separated from and spaced beneath the frame for engaging the outer portions of the bottles to maintain them in close clustered relationship, the area within the confines of the loop bar being larger than the area within the confines of the frame, and a plurality of spaced apart depending supports extending diagonally outwardly from the outer perimeter of the frame to the loop bar for supporting the bottle retaining loop bar in spaced apart relation to the frame and exposing the bottles to view through the spaces defined between the frame and the loop bar and between adjacent depending supports.

2. A bottle carrier as set forth in claim 1 in which the bottle retaining loop bar is a continuous bar which extends around the cluster of bottles engaging the shoulder portions of the bottles in the cluster and in which the depending supports are relatively rigid, but bendable struts which form a plurality of relative rigid, but bendable connections between the frame and the loop bar.

3. A bottle carrier as set forth in claim 1 including a wedge-shaped divider formed integrally with and depending from the underside of the frame to engage adjacent bottles in the cluster.

4. A bottle carrier as set forth in claim 1 in which the bottle retaining loop is capable of encompassing the upper frame of an underneath carrier to permit nesting of a pair of bottle carriers.

5. An integrally formed bottle carrier comprising a plurality of bottle engaging means for receiving and supporting therein the necks of bottles, a frame for supporting the bottle engaging means in spaced apart relationship to each other to insure that the bottles are closely clustered together, a bottle retaining loop bar beneath the frame for engaging the outer portions of the bottles to maintain them in close clutered relationship, depending supports from the frame for supporting the bottle retaining loop bar in spaced apart relation to the frame, a wedge-shaped divider formed integrally with and depending from the frame to engage adjacent bottles in the cluster, the perimeter of the bottle retaining loop bar being larger than the perimeter of the frame and the upper and lower wedge-shaped dividers intermeshing to permit nesting of a pair of bottle carriers and an opening in the frame above the depending divider to accommodate the depending divider of an upper bottle carrier when the carriers are nested.

6. An integrally formed bottle carrier comprising a plurality of bottle supporting collars for receiving and supporting therein the necks of bottles, a frame for supporting the collars in spaced apart relationship to each other to insure that the bottles are closely clustered together, a bottle retaining loop bar beneath the frame for engaging the outer portion of the bottles to maintain them in close clustered relationship and depending supports from the frame for supporting the bottle retaining loop bar in spaced apart relation to the frame, and in which the bottle supporting collars are bottle closures integrally formed with the frame to interlock with the necks of the bottles.

7. A bottle carrier as set forth in claim 6 including skirts depending from and separably connected with the closures to grip the necks of the bottles and separate from the closures when the bottles are removed from the closures.

8. A bottle carrier as set forth in claim 5 including a stop formed within the lower wedge divider to limit the nesting relationship of a pair of nesting bottle carriers.

9. A bottle carrier as set forth in claim 3 in which the wedge-shaped divider includes a pair of diagonal bottle engaging members depending from the upper frame.

10. A bottle carrier as set forth in claim 9 including flexible means connecting the lower ends of the diagonal bottle engaging members.

11. An integrally formed bottle carrier comprising a plurality of bottle closures for engaging and sealing the upper open ends of a plurality of bottles supported thereby, a frame for supporting the closures in spaced apart relationship to each other to insure that the bottles are closely clustered together, a bottle retaining bar beneath the frame and forming a loop for engaging the outer portions of the bottles to maintain them in close clustered relationship and depending supports from the frame for supporting the bar in spaced relationship to the frame.

12. A bottle carrier as set forth in claim 11 including a depending skirt formed on the lower end of a bottle closure and snugly gripping the neck of the bottle and a weakened line connecting the skirt and the closure so that the removal of a bottle from one of the closures separates the skirt from the closure.

13. An integrally formed bottle carrier comprising a plurality of neck engaging means for receiving and supporting therein the necks of bottles, a frame for supporting the bottle neck engaging means in spaced apart relationship to each other to insure that the bottles are closely clustered together, said neck engaging means including a bottle neck pivoting fulcrum within the outer portion of the frame and a pair of spreadable neck releasing members opposite the fulcrum so that the neck can be forced between the spreadable members to release the bottle from the frame, a bottle retaining loop bar spaced apart from and beneath the frame for engaging the outer portions of the bottles to maintain them in close clustered relationship, and a plurality of depending supports connecting the outer perimeter of the frame and the loop bar for supporting the bottle retaining loop bar in spaced apart relation to the frame and for determining the height at which the loop bar engages the bottles.

14. An integrally formed one-piece injection molded bottle carrier in which a plurality of bottles can be carried in a tight cluster without substantial concealment or cover of the upper portions of the bottles by the carrier comprising a plurality of bottle neck engaging means for receiving and supporting therein the necks of bottles, means for supporting said bottle neck engaging means in spaced array and at distances which support the bottles in a tight cluster, a pair of spreadable neck releasing members forming part of said bottle neck engaging means spreadable to release the bottle from the frame, a bottle retaining loop bar spaced apart from and beneath the bottle neck engaging means for engaging the outer portions of the bottles to maintain them in a tight cluster and a plurality of spaced apart depending supports connecting said support means and the loop bar for supporting the bottle retaining loop bar and for determining the height at which the loop bar engages the bottles and exposing the bottles to view through the spaces defined between the spaced apart depending supports.

* * * * *

UNITED STATES PATENT AND TRADEMARK OFFICE

CERTIFICATE OF CORRECTION

PATENT NO. : 4,235,468

DATED : November 25, 1980

INVENTOR(S) : Gerald Erickson

It is certified that error appears in the above—identified patent and that said Letters Patent is hereby corrected as shown below:

Column 5, line 20, "clutered" should be --clustered--.

Signed and Sealed this

Tenth Day of March 1981

[SEAL]

Attest:

RENE D. TEGTMEYER

Attesting Officer

Acting Commissioner of Patents and Trademarks